United States Patent [19]

Ince

[11] Patent Number: 4,748,544

[45] Date of Patent: May 31, 1988

[54] TORCH

[76] Inventor: Rex D. I. Ince, P.O. box 2050, Cape Town, South Africa, 8000

[21] Appl. No.: 900,379

[22] Filed: Aug. 26, 1986

[51] Int. Cl.[4] ..... F21L 7/00

[52] U.S. Cl. ..... 362/203; 362/189; 362/802

[58] Field of Search ..... 362/203, 202, 208, 189, 362/196, 802, 458, 109

[56] References Cited

U.S. PATENT DOCUMENTS

| | | | |
|---|---|---|---|
| 1,986,242 | 1/1935 | Zook | 362/203 |
| 2,235,714 | 3/1941 | Lennan | 362/189 X |
| 2,363,825 | 11/1944 | Yardeny | 362/203 X |
| 2,477,984 | 8/1949 | Jackson | 362/203 X |
| 3,805,050 | 4/1974 | Spiegel | 362/802 X |
| 4,433,365 | 2/1984 | Rousseau | 362/189 |
| 4,481,561 | 11/1984 | Lanning | 362/802 X |

*Primary Examiner*—Larry Jones

[57] ABSTRACT

A torch is disclosed which comprises a casing for receiving a cell and a head which screws onto the casing. The head contains a light bulb, a mounting for the bulb and a reflector. The cell is gripped while it is in the casing to prevent it moving freely along the casing. It can, however, move when the torch is tapped on one or other end or is knocked on a surface with sufficient force to overcome the restraint which is applied to the cell. The cell can also be caused to move by 'flicking' the torch. The cell can be gripped by a leaf spring which extends along the casing between the cell and the inner face of the casing, the leaf spring being slightly deformed as the cell is pushed into the casing and thus exerting a lateral thrust on the cell. Alternatively, there can be a wedge which when pushed into the casing urges the cell laterally. In another form the casing itself can be closed onto the cell when the head of the torch is screwed onto the casing.

13 Claims, 5 Drawing Sheets

TORCH

This invention relates to torches.

Torches conventionally have a switch which is operable from outside the casing. Commercially used switches tend not to be too robust and quite often fail. Corrosion of the metal parts of the switch is also a factor that limits the useful life of the switch and hence of the torch itself.

Conventional switches require there to be an operating element e.g. a slide or a button on the outside of the casing, the remainder of the switch being within the torch casing and connected into the electrical circuit of the torch. Such arrangements are difficult to seal hermetically and hence such unsealed torches cannot be used in explosive atmospheres because of the risk of an explosion being caused should the switch spark.

Conventional switches are also difficult to operate when the user is wearing thick protective gloves which make it difficult to 'feel' and operate a small button or slider. Also, such a switch often necessitates either the use of two hands (one to grip the torch and one to operate the switch) or at least a way of immobilising the torch so that the switch can be operated. This can be difficult in confined spaces.

The main object of the present invention is to provide a torch which is hermetically sealed and which can be operated using one hand.

According to the present invention there is provided a torch which comprises a casing for receiving a cell, a head including means for mounting a bulb, and means for exerting a lateral force on a cell inside the casing so that the cell is frictionally restrained and prevented from moving along the casing until an inertial force of sufficient magnitude to overcome the frictional restraining force is exerted on the torch.

To one form the lateral force exerting means comprises a strip extending along the inside of the casing, the arrangement being such that, as a cell is pushed into the casing, the strip is deformed and deformation of the strip causes it to exert said lateral force on the cell.

In another form the lateral force exerting means comprises an elongate strut of tapering form which, in use, is between the casing and a cell in the casing. In this form the casing can include a tapering internal groove which receives said strut, the arrangement being such that the strut is shifted laterally as it is inserted into the groove.

In still another form said casing has a number of parallel, axially extending splits with tongues between them, the force exerting means serving to close-up said splits so that the tongues bear on a cell in the casing.

In a further form, or as an additional feature of the previously described form, said torch includes a sleeve forming part of said head, said sleeve having a number of longitudinally extending splits therein with tongues between them, said splits being closed-up as the head is mounted on the casing so that the tongues of the sleeve close onto a cell in the casing.

In yet another form, the torch comprises a cell holder which includes upper and lower portions which serve to receive a cell between them, the cell and cell holder, in use, moving as a unit in the torch casing, and a contact formation above said upper portion, said contact formation moving into and out of engagement with a part of the torch head as the cell holder moves in the casing. In one specific embodiment of this form said strip constitutes said cell holder. In another embodiment said cell holder includes said strip and a strut, said portions being part of the strut and said contact formation being part of the strip, said strip being between the strut and the inner face of the torch casing.

Said casing can be dimensioned so as to receive one cell but preferably is able to receive two or more cells in series. Where there are two or more cells, said lateral force exerting means can exert, in use, a greater force on one cell in the casing than on the other cell or cells in the casing.

BRIEF DESCRIPTION OF THE DRAWINGS

For a better understanding of the present invention reference will now be made, by way of example, to the accompanying drawings in which each of FIGS. 1 to 5 is an axial section through a torch in accordance with the present invention.

The torch shown in FIG. 1 is designated generally by reference numeral 10. The torch 10 has a tubular cylindrical casing 12 to which a head 14 is secured, in an hermetically sealed manner, by means of a screw threading. The casing 12 and head 14 are of a high impact type, synthetic plastics material which can be transpatent. Two cells 16.1 and 16.2 are received in the casing 12. A bulb 18 is received in a metal holder 20 which incorporates a reflector 22. The holder 20 and the reflector 22 are housed in the head 14. The reflector 22 is of metal and makes electrical contact with the holder 20. The holder 20 forms one electrical contact for the bulb 18 and a nipple 24 forms the other contact of the bulb 18. The cells 16.1 and 16.2 each have a positive contact 26 and a negative contact 28.

A metal strip 30 is also housed in the casing 12. The strip 30 can be of spring steel.

Figure 1:
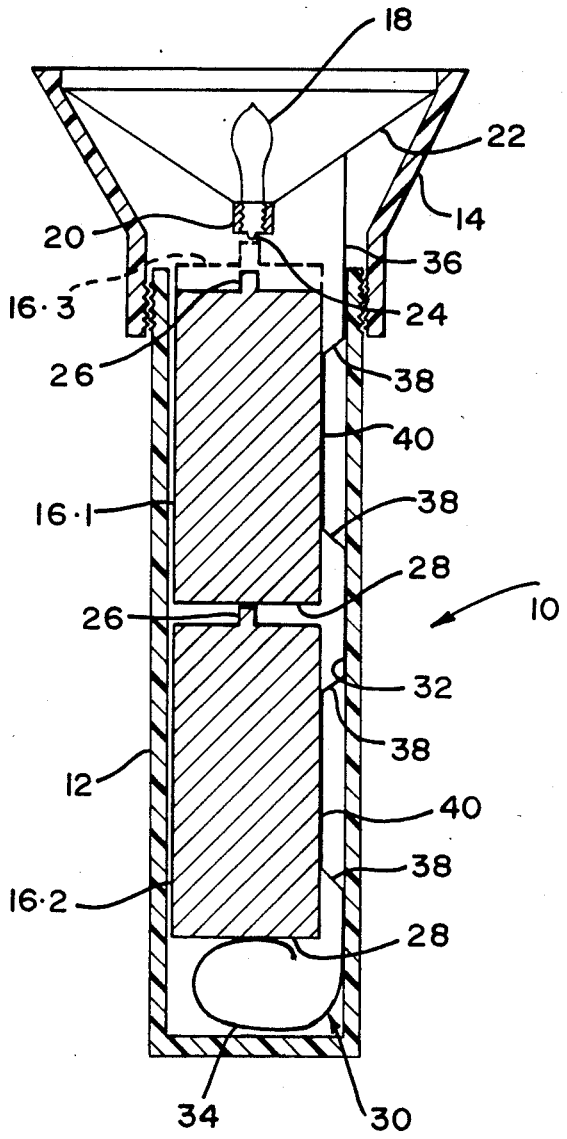
As shown in FIG. 1, the strip 30 has a main portion 32 that extends the length of the casing 12, a curved tail portion 34 at one end and a reflector contacting portion 36 at the other end. The tail portion 34 is located at the bottom of the casing 12 and makes contact with the negative contact 28 of the cell 16.2. The portion 36 makes electrical contact with the reflector 22 when the head 14 is fully screwed onto the casing 12. As the tail portion 34 is curved and is resilient, it can uncurl to some extent and still remain in contact with the cell 16.2. The main portion 32 is cranked at four locations 38 thereby to provide two protruding sections 40. The sections 40 engage the cells 16.1 and 16.2 and urge them against the opposed inner face of the casing 12 so that the cells are frictionally held in position.

It will be understood that if the casing 12 is struck sharply at its end remote from the head 14 or is knocked on a surface, this will exert inertial forces on the cells 16.1 and 16.2 tending to move them away from the head 14. Similarly, if the head 14 is struck or knocked on a surface this will tend to move the cells 16.1 and 16.2 towards the bulb 18. Thus, if the torch is to be switched on, the head 14 is struck or knocked causing the cells 16.1 and 16.2 to move towards the bulb 18 and make contact therewith while still remaining in contact with one another and with the tail portion 34 thereby closing a circuit constituted by the cells 16.1 and 16.2, the bulb 18, the reflector 22 and the metal strip 30. If the torch 10 is to be switched off, the casing 12 is struck or knocked causing the cells 16.1 and 16.2 to move away from the bulb 18 so that the electric circuit is broken. The full line position of the cells is the 'off' position. When the cells move to the 'on' position, the cell 16.1 takes-up the position shown by the dashed line 16.3, the other cell 16.1 moving commensurately.

The sections 40 can be such that the lateral force exerted on the cell 16.2 is less than the lateral force exerted on the cell 16.1. Thus when the torch is struck, it is the cell 16.2 which moves most readily. Thus the contact 26 of the cell 16.2 moves away from the contact 28 of the cell 16.1. The cell 16.1 in this arrangement is always in position 16.3. When the cells are replaced a new switch mechanism is, in effect, provided.

The strip 30, instead of being cranked as shown, can have a series of sinusoidal bends therein.

Figure 2:
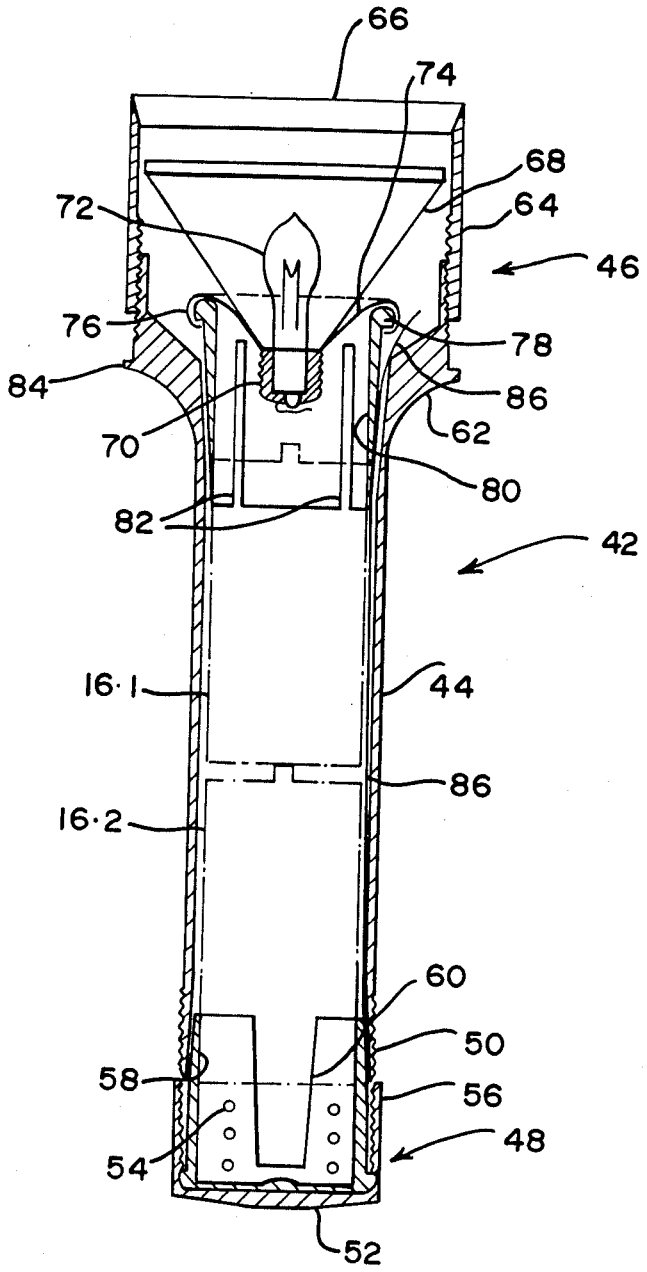

The torch 42 illustrated in FIG. 2 comprises a generally cylindrical casing 44, a head 46 and a base cap 48. The casing 44 is externally threaded at 50 and, internally, tapers slightly over a short section so that the inside diameter of the casing 44 decreases progressively from the open end thereof for a short distance and is then cylindrical.

The cap 48 comprises a transverse end wall 52 against the inner face of which a light spring 54 bears. An internally threaded sleeve 56 extends from the periphery of the end wall 52, the threading of the sleeve 56 being compatible with that of the casing 44. A further sleeve 58 protrudes from the end wall 52, the sleeve 58 being radially inwardly of and co-axial with the sleeve 56. The sleeve 58 is formed with a pair of diametrically opposed splits 60 and is externally tapered over the section thereof remote from the wall 52. The sleeve 58 includes tongues between the splits 60 thereof.

When the cap 48 is screwed onto the casing 44, the tapering section of the sleeve 58 engages the tapering section of the casing 44. It will be understood that, in FIG. 2, the cap 48 is not shown screwed onto the casing 44. As the cap 48 is screwed on, the sleeve 58 is reduced in diameter, the splits 60 allowing the tongues of the sleeve 58 between the splits 60 to move radially inwardly.

The other end of the casing 44 flares outwardly to form an externally threaded mounting portion 62 for the head 46. The head 46 comprises an internally threaded sleeve 64 with a protective transparent glass 66 across one end thereof. A reflector 68, a bulb mount 70 and a bulb 72 all form part of the head 46.

A contact 74 of conical form is secured to the bulb mount 70. The periphery of the contact 74 is turned over to form a rim 76 which is clinched to a head 78 at one end of a sleeve 80. The sleeve 80 tapers externally over the lower section thereof so that the outside diameter of the lower end thereof is smaller than the outside diameter of the remainder thereof. The sleeve 80 is formed with a number of longitudinally extending splits 82 which extend from adjacent the bead 78 to the other end of the sleeve thereby giving rise to a plurality of tongues.

The portion of the casing 44 that the sleeve 80 enters is internally tapered, the angle of taper substantially matching that of the sleeve 80.

A peripherally extending stop 84 protrudes from the casing 44 and limits movement of the head 46 onto the casing. It will be understood that, in the condition illustrated, the head 46 is not shown fully screwed onto the casing 44.

A metallic contact strip 86 extends down the inside of the casing 44 and connects to the spring 54 of the cap 48. In one form this is acheived by making the sleeve 58 of metal and extending the contact strip far enough to touch it.

If it is assumed that the head 46 and cap 48 have both been removed from the casing 44, then the two cells 16.1, 16.2 can be slid into the casing 44 from either end. The base cap 48 is then screwed on. As the base cap 48 moves further and further onto the casing 44, the taper on the inner face of the casing 44 tends to reduce the diameter of the sleeve 58 by closing up the cut-outs 60. The tongues of the sleeve 58 thus grip the cell 16.2 and electrical contact between the cell 16.2 and the strip 86 is made via the spring 54 and the metallic parts of the cap 48.

As the head 46 is screwed on, the sleeve 80 enters the tapering end section of the casing 44. The slits 82 progressively close and the overall diameter of the sleeve 80 is reduced so that the cell 16.1 is gripped. Just before the sleeve 64 reaches the stop 84, the rim 76 of the contact 74 engages the contact strip 86. Until this occurs, which means that the head has been screwed on fully, the circuit through the torch cannot be completed.

When the torch is slapped on the head 46 or on the base cap 48, the cells tend to move along the casing 44. They cannot, however, move completely freely because they are gripped by the sleeves 58 and 80. This means that light shocks cannot move the cells. In the form illustrated, the torch is 'on' when the cell 16.1 is in contact with the bulb 72. The electrical circuit includes both cells 16.1, 16.2, the spring 54, the metallic parts of the cap 48, the strip 86 and the conical contact 74. When the cap 48 is slapped, or the torch is knocked onto a surface, the cells 16.1, 16.2 slide towards the cap 48 compressing the spring 54. The cell 16.1 thus moves out of contact with the bulb 72.

To switch the torch on, the head 46 is slapped or knocked onto a surface to shift the cells in the opposite direction. The spring 54 is chosen so that the force exerted thereby is too light to shift the cells towards the head 48 against the frictional restraint exerted by the sleeves 58 and 80.

If the spring 54 positioned between the cell 16.1 and the bulb 72, then the torch goes on when the base is knocked to shift the cell 16.2 into engagement with the metallic part of the cap 48. The spring 54 maintains electrical contact between the cell 16.1 and the bulb 72 even though the cell 16.1 has moved away from the bulb 72 as the cell 16.2 moved towards the cap 48.

If one sleeve 58, 80 grips its cell more firmly than does the other, then with a knock or slap of sufficient magnitude, the less firmly gripped cell will move away from the other. It is the cell on which the spring 54 bears which must be free to move.

When the head 46 and cap 48 are removed, the gripping action exerted on the cells ceases, and they drop freely from the casing 44.

The torch can, if desired, have a single cell which means that only the head 46 or the cap 48 need include a sleeve which closes onto the cell so as frictionally to restrain it.

Figure 3:
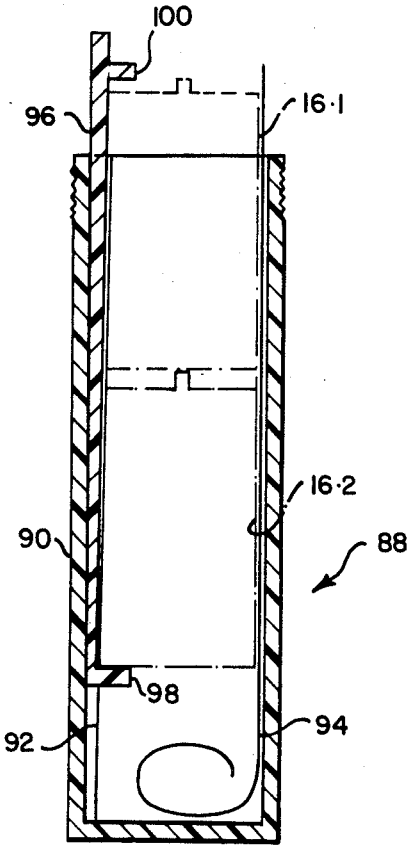

Turning now to FIG. 3, this shows a further torch 88 which comprises a casing 90 which has a vertically extending tapering groove 92. The taper of the groove 92 is considerably exaggerated in FIG. 3. A metal contact strip 94 extends from the bottom end of the casing 90 to the top to make contact with a head (not shown in FIG. 3) but equivalent to the head 14 of FIG. 1.

A loose strut 96 (shown partially inserted into the casing 90) lies in the groove 92 and extends from close to the bottom of the casing 90 to a position just beyond the mouth of the casing. The protruding portion of the strut 96 is received, when the head is screwed onto the casing 90, between the head and the reflector (equivalent to the reflector 22 of FIG. 1).

The strut 96 is wedge-shaped and has a projecting foot 98 at the lower end thereof and a small projection 100 on that portion thereof which, when the strut is fully inserted into the casing 90, is just inside the casing. The distance between the foot 98 and the projection 100 is somewhat more than the overall length of the two cells 16.1 and 16.2.

To remove the cells 16.1 and 16.2 from the casing 90, the head is unscrewed and the end of the strut 96 gripped. It is then pulled out of the casing 90. The foot 98 bears on the underside of the lower cell 16.2 and the two cells are thus lifted with the strut 96.

As the strut 96 slides upwardly from the casing 90, the wedging action which had previously held the cells 16.1 and 16.2 between the strut 96 and the opposed wall of the casing 90 lessens, the strut being withdrawn until the foot 98 is just inside the open mouth of the casing 90. The cells 16.1 and 16.2 can then be removed.

A new cell 16.2 is then placed on the foot 98 and the strut 96 slid into the casing 90 somewhat. The new cell 16.1 is then placed on the partially inserted cell 16.2 and the strut and cells then slid into the casing 90. The tapers of the groove 92 and the strut 96 cause the strut, in effect, to move towards the axis of the casing 90 as it slides down the groove 92. Eventually the cells are gripped between the strut 96 and the diametrically opposed part of the casing 90.

The cells 16.1, 16.2 are now incapable of free movement along the casing 90. They can only move if the torch is slapped (either on the head or on the base of the casing 90) to cause inertial forces on the cells. They then either shift downwardly so that the positive contact of the cell 16.1 moves away from the bulb, or moves upwardly into contact with the bulb. It will be understood that the resilience of the curved tail portion of the strip 94 enables it to follow movement of the cells thereby to ensure that contact continues to be made.

The function of the projection 100 is to limit movement of the cells towards the bulb.

If desired, the configuration of the strut 96 can be such that one of the cells is more firmly gripped than the other. The result of this is that when the torch is slapped or flicked, one of the cells 16.1 or 16.2 shifts with respect to the other so that the on-off action results from making and breaking of contact between the cells.

Figure 4:
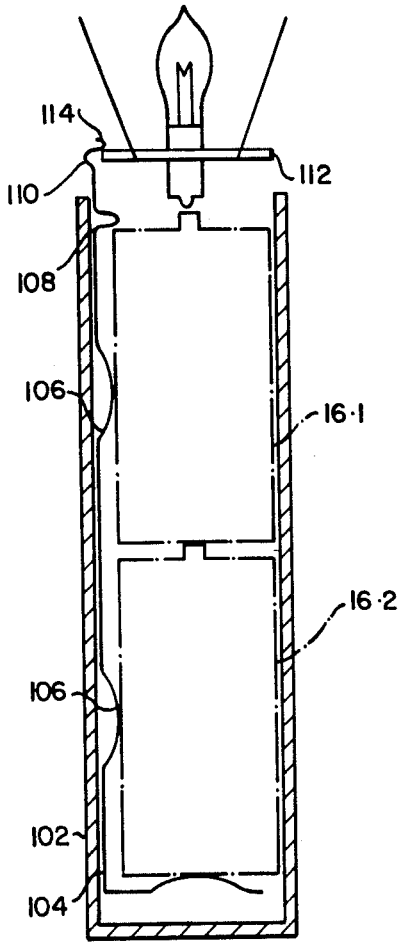

The torch illustrated in FIG. 4 comprises a cylindrical casing 102 which is closed at the lower end. A combined contact and lateral force exerting strip 104 extends from outside of the casing 102 to a position close to the closed end of the casing 102. The element 104 is of spring steel or copper. The strip 104 supports the lower cell 16.2 and is formed with two resiliently deformable curved portions 106 which urge the cells 16.1, 16.2 laterally against the opposed inner face of the casing 102. The strip 104 is, near its upper end, bent to form a cell retaining protrusion 108. Above the protrusion 108 the strip 104 is formed with a structure 110 which co-operates with a metal plate 112 forming part of the head of the torch. The head has been partially shown. The structure 110 includes a lip 114 which hooks over the edge of the plate 112 when the cells 16.1, 16.2 and the strip 104 are moved away from the closed end of the casing. This completes the circuit. The lip 114 disengages from the plate 112 and separates from it when the torch is slapped, flicked or knocked on a surface to displace the cells 16.1, 16.2 and the strip 104 towards the closed end of the casing.

In a modified form of the torch of FIG. 4 there is a strut which is similar to the strut 90 but is not tapered. The strip 104 in this form is between the casing 102 and the strut and urges the strut and the cells laterally. The upper end of the strip 104 includes the structure 110 but not the protrusion 108, the protrusion in this embodiment forming part of the strut. The portion of the strip 104 which is at the closed end of the casing 102 in this form serves as an electrical contact only and not for the purpose of supporting the cells.

Figure 5:
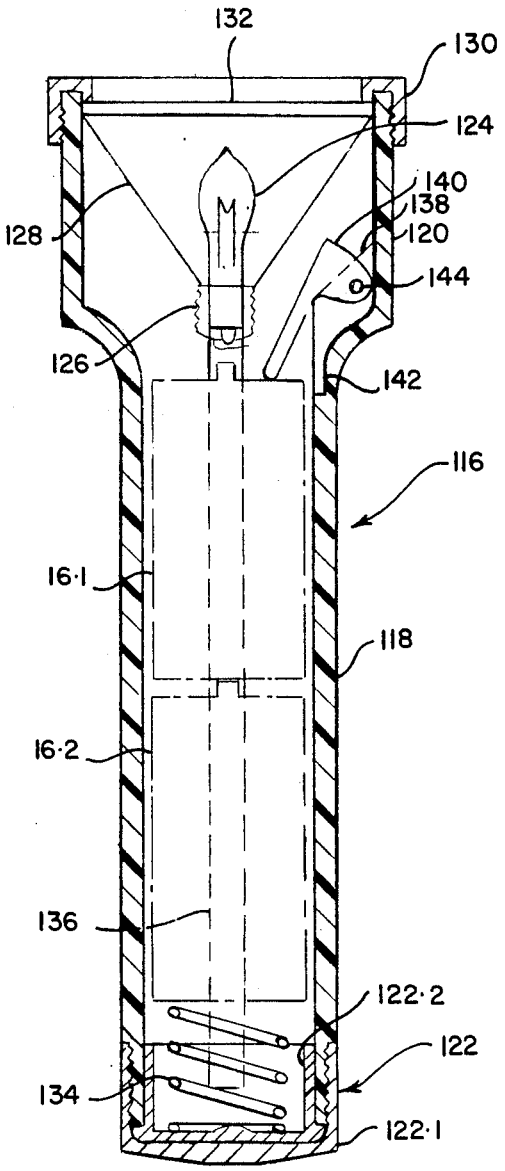

The torch of FIG. 5 comprises a one piece body 116 which provides a cylindrical casing 118 and an enlarged head 120. The end of the casing 118 remote from the head is closed by a screw-on cap 122. The cap 122 includes a plastic outer part 122.1 and a metallic inner part 122.2. A bulb 124 is carried by a bulb holder 126 which incorporates a reflector 128. The periphery of the reflector 128 is held in place by a ring 130 which screws onto the head 120. The ring 130 also holds a transparent disc-like cover 132 in place.

The cells 16.1, 16.2 are urged against the bulb 124 by a coil spring 134 which is between the cap 122 and the cell 16.2.

The torch also includes a metallic strip 136 which connects between the metallic inner part 122.2 of the cap 122 and the reflector 128. The strip 136 can, if desired, be cranked to provide sections which urge the cells laterally in the casing 118 in the same way as do the sections 40 of FIG. 1. The cranked sections can, however, be omitted.

Internally of the body 116, at the region where the casing 118 and head 120 merge, there is a web 138 on which a lever 140 is pivotally mounted. Immediately below the web 138 there is a short axially extending slot 142. A pin 144 passes through the web 138 and lever 140 to form the pivotal mounting of the lever 140 on the web 138. The lever 140 can swing between the full line position illustrated and a position in which the long arm of the lever 140 is vertical and in the slot 142. In the full line position the lever engages the cell 16.1.

When the lever 140 is in the illustrated position, the spring 134 urges the cell 16.1 against the lever 140. The positive contact of the cell is thus spaced from the bulb 124 and the torch is 'off'.

If the torch is orientated horizontally with the lever 140 at 'bottom dead centre' and slapped, knocked or flicked with sufficient force, the cells 16.1, 16.2 move towards the cap 122 against the action of the spring 134. The lever 140 pivots downwardly about the axis of the pin 144 as the cell 16.1 clears it and drops into the slot 142. The spring 134 can then urge the cells 16.1, 16.2 along the casing 118 so that the positive contact of the cell 16.1 engages the bulb 124. The torch is now 'on'. To switch the torch 'off', it is held horizontally with the lever 140 at 'top dead centre'. It is again flicked, slapped or knocked to cause the cells to move along the casing 118 against the action of the spring 134. The lever 140, as the cell 16.1 clears it, drops out of the slot 142 and pivots back to the position illustrated and thus again prevents contact between the cell 16.1 and the bulb 124. The lever 142 provides a positive lock against the torch accidentally being knocked and switched on.

If the strip 136 has cranked sections, then while the lever 140 is in the slot 142, the torch can be operated in the same way as the embodiments of FIGS. 1 to 4 by causing the cells 16.1, 16.2 to move along the casing. The torch is always held with the lever at 'bottom dead centre' during operation in this way so that it cannot move into the illustrated position. The spring 134 in this form serves as an electrical connection only and is too weak to overcome the frictional restraining force exerted on the cells 16.1, 16.2 by the cranked sections.

While most conveniently provided at the position shown, the lever 140 could be provided half way along the casing 118 to co-operate with the cell 16.2. Similarly, while a pivotally mounted lever is preferred, any element which can move e.g. slide between a first position in which it is in the path of movement of one of the cells and a second position which it is out of the path of movement of that cell can be used.

While, in all embodiments illustrated, the casings are dimensioned to receive two cells in series, the casings can if desired be dimensioned such that they can receive one cell only or more than two cells in series.

I claim:

1. A torch which comprises a casing for receiving a cell, a head including means for mounting a bulb, means for exerting a lateral force on a cell inside the casing so that the cell is displaced laterally in the casing, a face on the opposite side of the cell to said means and against which said means urges the cell to frictionally restrain the cell and prevent it from moving along the casing until an inertial force of sufficient magnitude to overcome the frictional restraining force exerted on the cell by said means and face is exerted on the torch.

2. A torch as claimed in claim 1, wherein the lateral force exerting means comprises a strip extending along the inside of the casing, the arrangement being such that, as a cell is pushed into the casing, the strip is deformed and deformation of the strip causes it to exert said lateral force on the cell.

3. A torch as claimed in claim 2, wherein said strip has a series of sinusoidal bends therein.

4. A torch as claimed in claim 2, wherein said strip is cranked so as to provide a raised section which, in use, bears on said cell.

5. A torch as claimed in claim 2, and further including a cell holder which includes upper and lower portions which serve to receive a cell between them, the cell and cell holder, in use, moving as a unit in the torch casing, and a contact formation above said upper portion, said contact formation moving into and out of engagement with a part of the torch head as the cell holder moves in the casing.

6. A torch as claimed in claim 5, wherein said strip constitutes said cell holder.

7. A torch as claimed in claim 5, wherein said cell holder includes said strip and a strut, said portions being part of the strut and said contact formation being part of the strip, said strip being between the strut and the inner face of the torch casing.

8. A torch as claimed in claim 1, wherein the lateral force exerting means comprises an elongate strut of tapering form which, in use, is between the casing and a cell in the casing.

9. A torch as claimed in claim 8, wherein said casing includes a tapering internal groove which receives said strut, the arrangement being such that the strut is shifted laterally as it is inserted into the groove.

10. A torch as claimed in claim 1, and including an end cap which has a number of parallel, axially extending splits with tongues between them, the force exerting means serving to close-up said splits so that the tongues bear on a cell in the casing.

11. A torch as claimed in claim 1 or in claim 10, and including a sleeve forming part of said head, said sleeve having a number of longitudinally extending splits therein with tongues between them, said splits being closed-up as the head is mounted on the casing so that the tongues of the sleeve close onto a cell in the casing.

12. A torch as claimed in claim 1, wherein said casing is dimensioned so as to receive two or more cells in series, and wherein the lateral force exerting means exerts, in use, a greater force on one cell in the casing than on the other cell in the casing.

13. A torch which comprises a casing for receiving a cell, spring means for urging a cell in the casing towards an operative position in which the electrical circuit of the torch is complete and the torch is 'on', and an element which is displaceable between a first position in which it lies in the path along which the cell must move to reach said operative position and prevents said spring from urging the cell into said operative position, and a second position in which it is out of said path of movement and permits said spring to urge the cell to said operative position.

* * * * *